US005858036A

United States Patent [19]

Chandaria

[11] Patent Number: 5,858,036

[45] Date of Patent: Jan. 12, 1999

[54] ARTIFICIAL FIRE LOG

[75] Inventor: Kapoor Chandaria, Nairobi, Kenya

[73] Assignee: Conros Corporation, Scarborough, Canada

[21] Appl. No.: 864,577

[22] Filed: May 28, 1997

[51] Int. Cl.[6] ..... C10L 5/48; C10L 5/00

[52] U.S. Cl. ..... 44/535; 44/532; 44/533; 44/534

[58] Field of Search ..... 44/532, 533, 534, 44/535

[56] References Cited

U.S. PATENT DOCUMENTS

| | | |
|---|---|---|
| 225,244 | 3/1880 | Swift . |
| 1,050,535 | 1/1913 | Hartung . |
| 2,789,890 | 4/1957 | Stevens . |
| 3,637,355 | 1/1972 | Brockbank . |
| 3,726,651 | 4/1973 | Ronden . |
| 3,947,255 | 3/1976 | Hartman et al. . |
| 4,040,796 | 8/1977 | Vincent et al. . |
| 4,043,765 | 8/1977 | Tanner . |
| 4,046,518 | 9/1977 | Dalzell . |
| 4,104,034 | 8/1978 | Wu et al. . |
| 4,147,518 | 4/1979 | DeHart et al. . |
| 4,243,394 | 1/1981 | Kincaid . |
| 4,883,498 | 11/1989 | MacIsaac . |

*Primary Examiner*—Jerry D. Johnson
*Attorney, Agent, or Firm*—Sand & Sebolt

[57] ABSTRACT

A fire log formed with a groove in a bottom rear corner thereof. The groove is formed at a right angle and provides a protruding edge or lipped surface onto which the flame can latch and ignite the fire log. A generally V-shaped channel is formed in a front surface of the fire log by an arcuate upper section and a curved lower section. The outer wrapper forms a flap or wick which is used to ignite the fire log. The fire log is lit at the protruding edge formed by the groove and initially burns at opposed ends thereof. Flame gradually creeps inward along the rear and top surface, then gradually creeps down the front surface resulting in complete ignition of the fire log.

23 Claims, 6 Drawing Sheets

ARTIFICIAL FIRE LOG

BACKGROUND OF THE INVENTION

TECHNICAL FIELD

Generally, the invention relates to artificial fire logs. Particularly, the invention relates to an artificial fire log contained within a protective outer wrapper having a lightable flap which easily ignites the artificial fire log and which cooperates with a groove and a channel formed in the artificial fire log to burn the fire log in an aesthetically pleasing manner. Specifically, the invention relates to an artificial fire log having a groove formed in a bottom rear of the fire log and having a generally V-shaped channel formed in a front surface of the fire log, whereby the V-shaped channel provides an aesthetically pleasing flame while simultaneously providing the appearance that multiple logs are positioned in the fireplace, and the groove provides an easily ignitable protruding edge along the rear edge of the fire log.

BACKGROUND INFORMATION

Various types of fuel bodies have been developed, most of which are formed of particulate flammable materials which are compressed into a predetermined shape. The particulate materials are combined with various wax binders and other binders for maintaining the desired shape of the final fuel body. These bodies also may contain various types of additives therein to enhance burning or to produce a colored flame. Certain of these fuel bodies, and in particular, the elongated fuel body referred to as a fire log, are formed of compressed sawdust, coal particles or other flammable material. These fire logs are formed usually by a continuous extrusion process wherein the particulate flammable material and the appropriate binder and other materials are compressed within an extrusion bore, and then are cut into predetermined lengths, and subsequently placed in a protective outer wrapper.

These fire logs are generally used by residential home owners in a home fireplace to provide heat, and to provide an attractive fire closely simulating that of a natural wood fire. It is a common object of most artificial fire logs to provide some type of wick for rapidly igniting the fire log, preferably when a match is applied to the outer wrapper, eliminating the need for any starting fuels which could be a safety hazard. It is also desirable that the log burns uniformly instead of at only one end thereof, after being ignited by a starting match.

Another problem with these fire logs is that often the fire logs are lit such that they simultaneously burn from both the front and rear surfaces. By burning the logs from both the front and rear surfaces, the log will burn faster creating an increased and excessive amount of heat for a short duration rather than a desired moderate amount of heat for a longer duration.

A further problem with these fire logs is their cylindrical configuration does not provide an edge or lip onto which the flame can grab or latch, to ignite the fire log. Often, after the wick of the outer wrapper is ignited, the paper wrapper burns to the edge of the fire log adjacent the bottom thereof and is gradually extinguished. As the outer wrapper is burned around the log, the log provides no protruding edges or lips onto which the flame can grab.

Therefore, the need exists for an improved artificial fire log which is contained in an outer wrapper having a flap which functions as a wick, which produces a uniform and aesthetically pleasing flame along the entire length of the log when the flap is lit, which is formed with a groove which includes easily ignitable protruding edges.

BRIEF SUMMARY OF THE INVENTION

Objectives of the invention include providing an improved artificial fire log which is contained in a protective outer wrapper having a flap which functions as a wick and which is used to ignite the fire log.

Another objective is to provide a fire log which is formed with channels which provide an easily lightable protruding edge.

A still further objective is to provide a fire log which will initially burn at its opposed ends along only the rear surface before burning over the entire surface thereof.

A further objective is to provide a fire log which burns for a relatively long duration.

Another objective is to provide a fire log which is ignited from a bottom edge allowing the flame to travel upward along the front or rear surface of the log thus providing a larger ignitable surface area.

Another objective is to provide a fire logs which burns uniformly along the entire length of the log.

A still further objective is to provide a fire log which burns from start to finish in an aesthetically pleasing manner.

Another objective is to provide a fire logs which is of simple construction, which achieves the stated objectives in a simple, effective and inexpensive manner, which solves problems and satisfies needs existing in the art.

These objectives and advantages are obtained by the improved fire log of the present invention, the general nature of which may be stated as including an artificial fire log comprising: an elongated flammable body formed of compressed particulate material and a binder, said body having a pair of opposed end surfaces, a rear surface, a bottom surface, a top surface and a front surface, said front surface having an upper portion and a lower portion; and a groove formed in a corner of the body between the bottom surface and one of the rear and front surfaces.

These objectives and advantages are also obtained by the improved method of igniting an artificial fire log, the general nature of which may be stated as including the steps of igniting a flap of the protective outer wrapper; burning a bottom portion of the wrapper to a bottom rear corner of the fire log; and igniting a protruding edge adjacent a groove formed in the bottom rear corner of the fire log.

BRIEF DESCRIPTION OF THE DRAWINGS

The preferred embodiment of the invention, illustrative of the best mode in which applicant has contemplated applying the principles, is set forth in the following description and are shown in the drawings and is particularly and distinctly pointed out and set forth in the appended claims.

Similar numerals refer to similar parts throughout the drawings.

DESCRIPTION OF THE PREFERRED EMBODIMENTS

Figure 1:
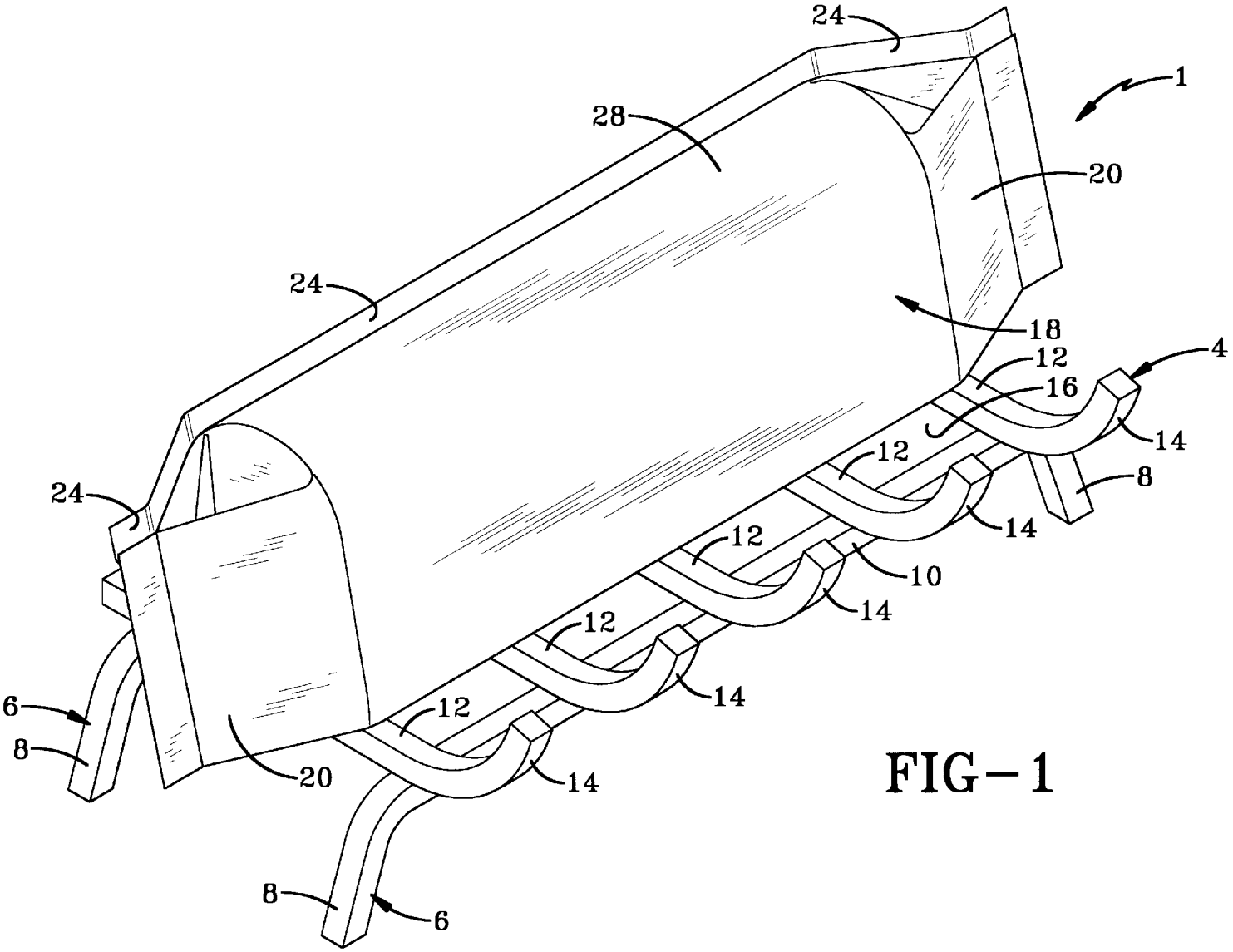
FIG. 1 is a front perspective view of the artificial fire log of the present invention contained within a protective outer wrapper.

The artificial fire log of the present invention is indicated generally a 1 in FIG. 1 and is shown sitting on a fireplace grate 4. Fireplace grate 4 includes a pair of supports 6 each having a pair of legs 8 and a cross member 10 extending between legs 8, and a plurality of ribs 12 extending between and connected to supports 6. Ribs 12 extend perpendicular to supports 6 and include an upwardly curved front end 14. Ribs 12 are parallel to one another and separated by a gap 16. Supports 6 and ribs 12 of fireplace grates 4 are preferably formed of iron or steel but may be formed of any material capable of withstanding the heat produced by fire log 1 without affecting the spirit of the invention.

Figure 2:
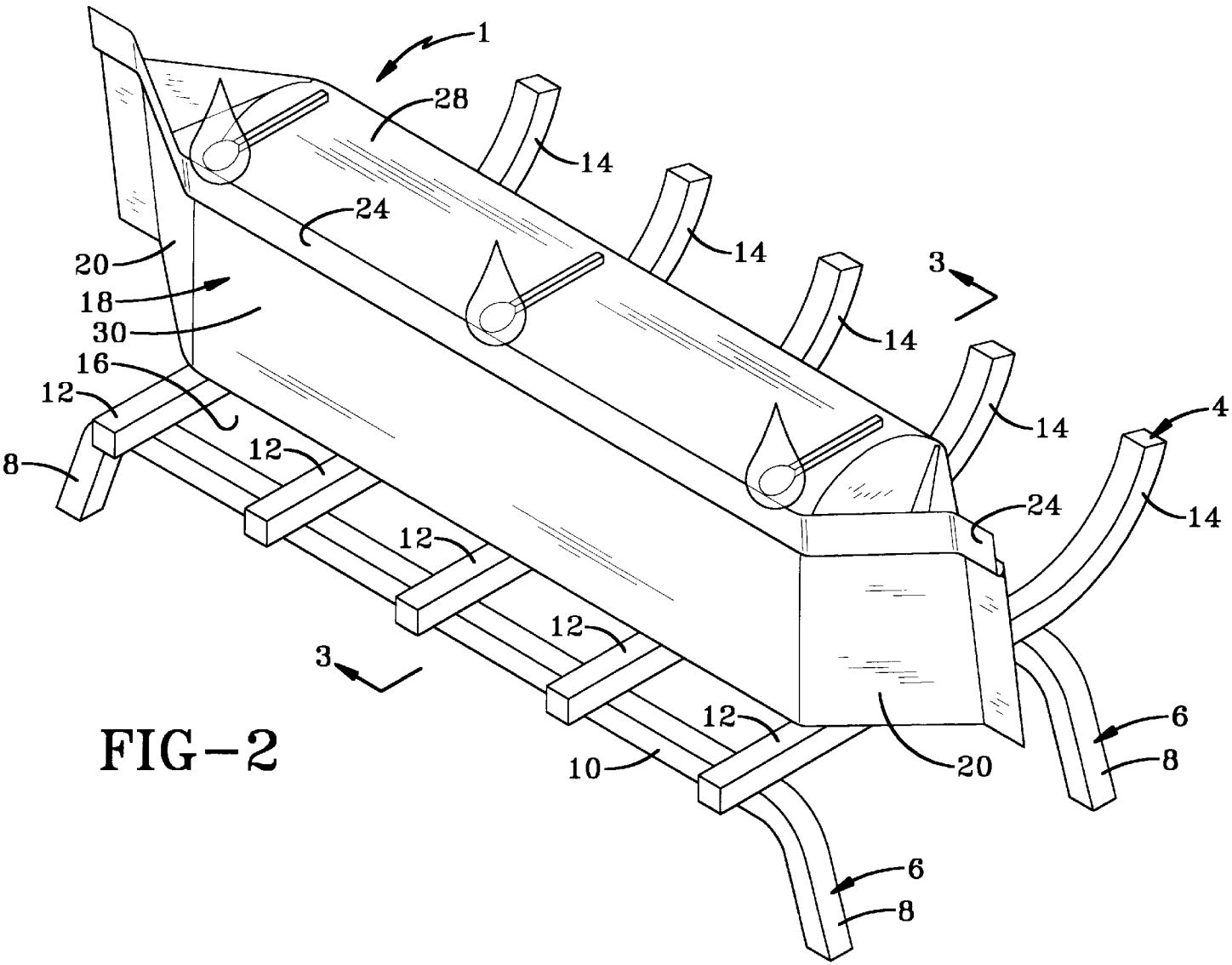
FIG. 2 is a rear perspective view of the fire log of FIG. 1 showing a flap of the outer wrapper being ignited.

Artificial fireplace log 1 is contained within a protective outer wrapper 18. Outer wrapper 18 is sealed at opposed ends 20 producing an airtight environment within outer wrapper. Ends 20 may be folded, twisted, or otherwise sealed to produce the airtight environment of wrapper 18 and are shown in FIGS. 1 and 2 folded and adhered in a closed, sealed manner. As shown in FIG. 2, wrapper 18 is sealed along the length of fire log 1 by an outwardly extending flap 24 formed by adhering excess material of a top portion 28 of wrapper to excess material of a bottom portion 30 of wrapper 18.

Figure 3:
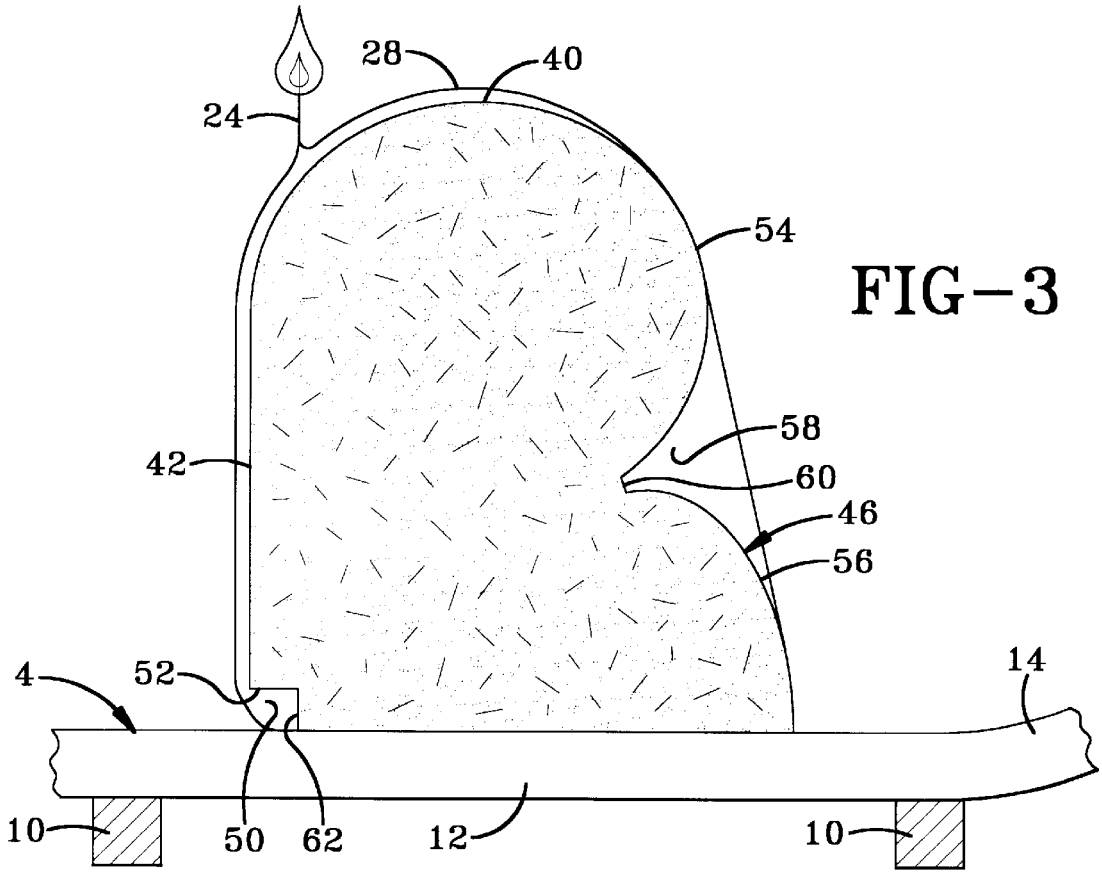
FIG. 3 is a sectional end view of the fire log of FIG. 2 shown with the flap ignited.
Figure 5:
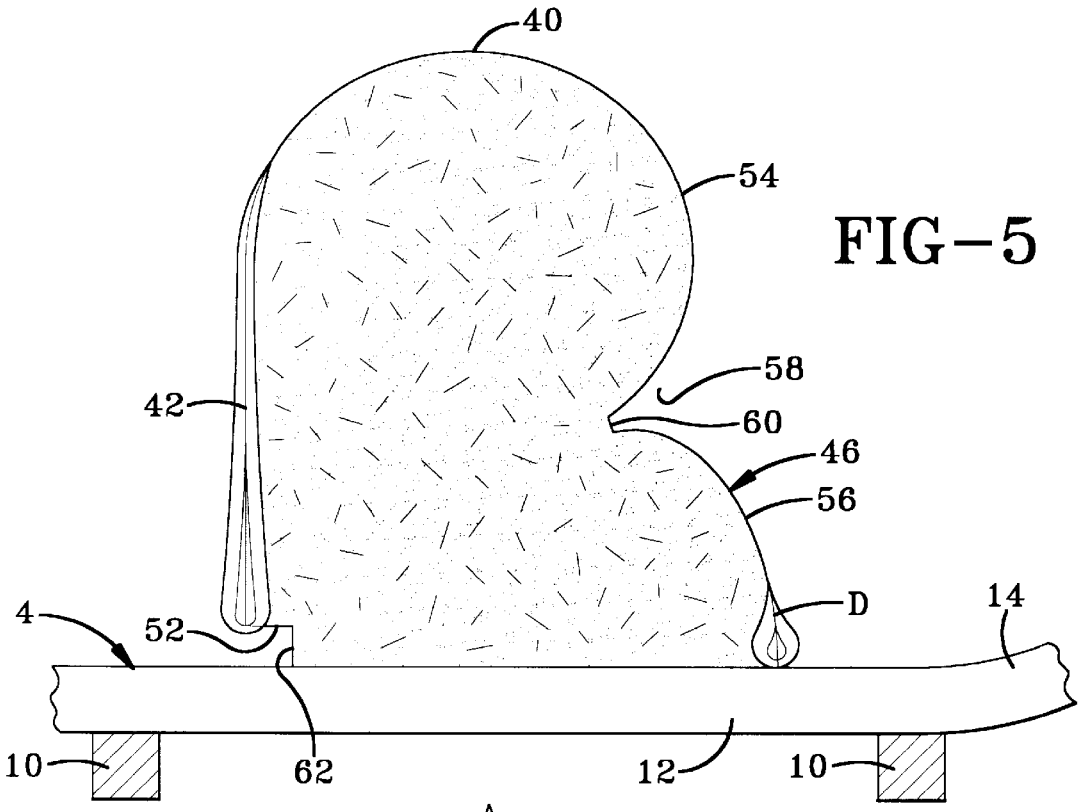
FIG. 5 is a sectional end view similar to FIG. 4 showing the fire log partially ignited.
Figure 7:
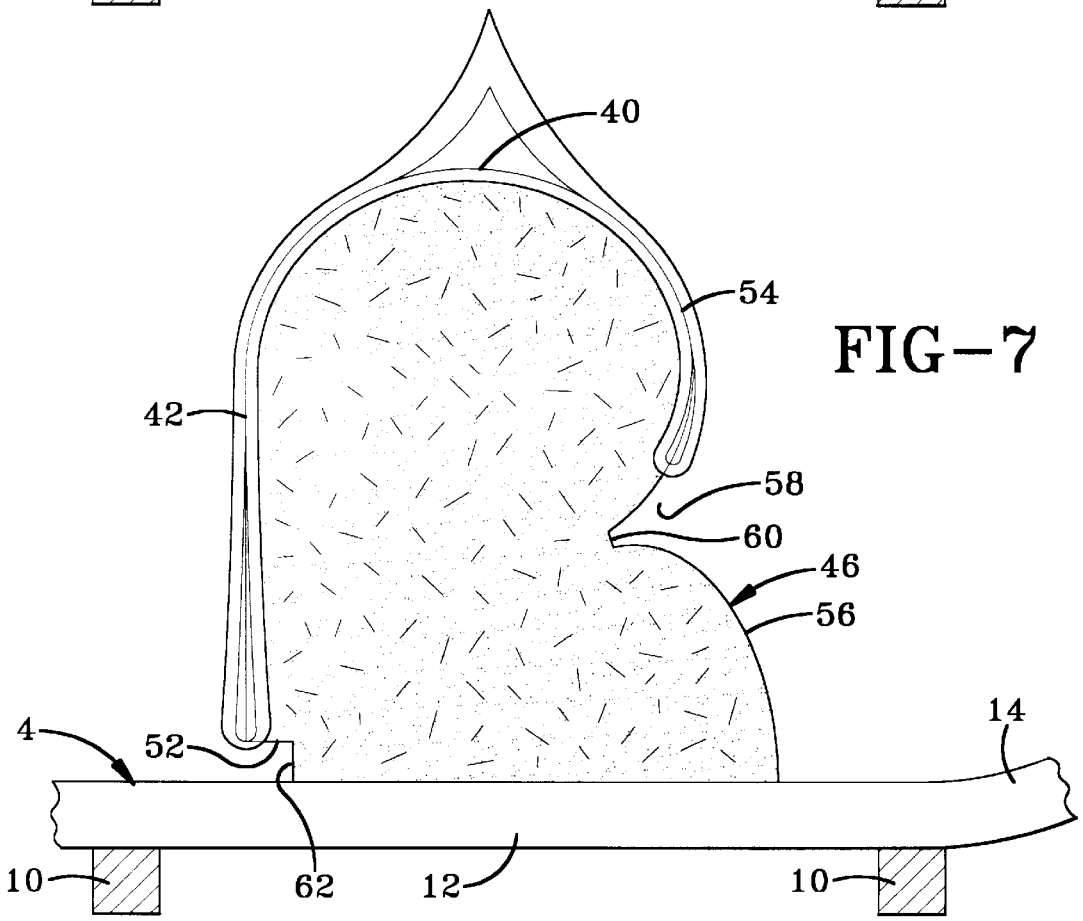
FIG. 7 is a sectional end view similar to FIG. 5 showing the flame traveling down the front surface of the fire log.
Figure 6:
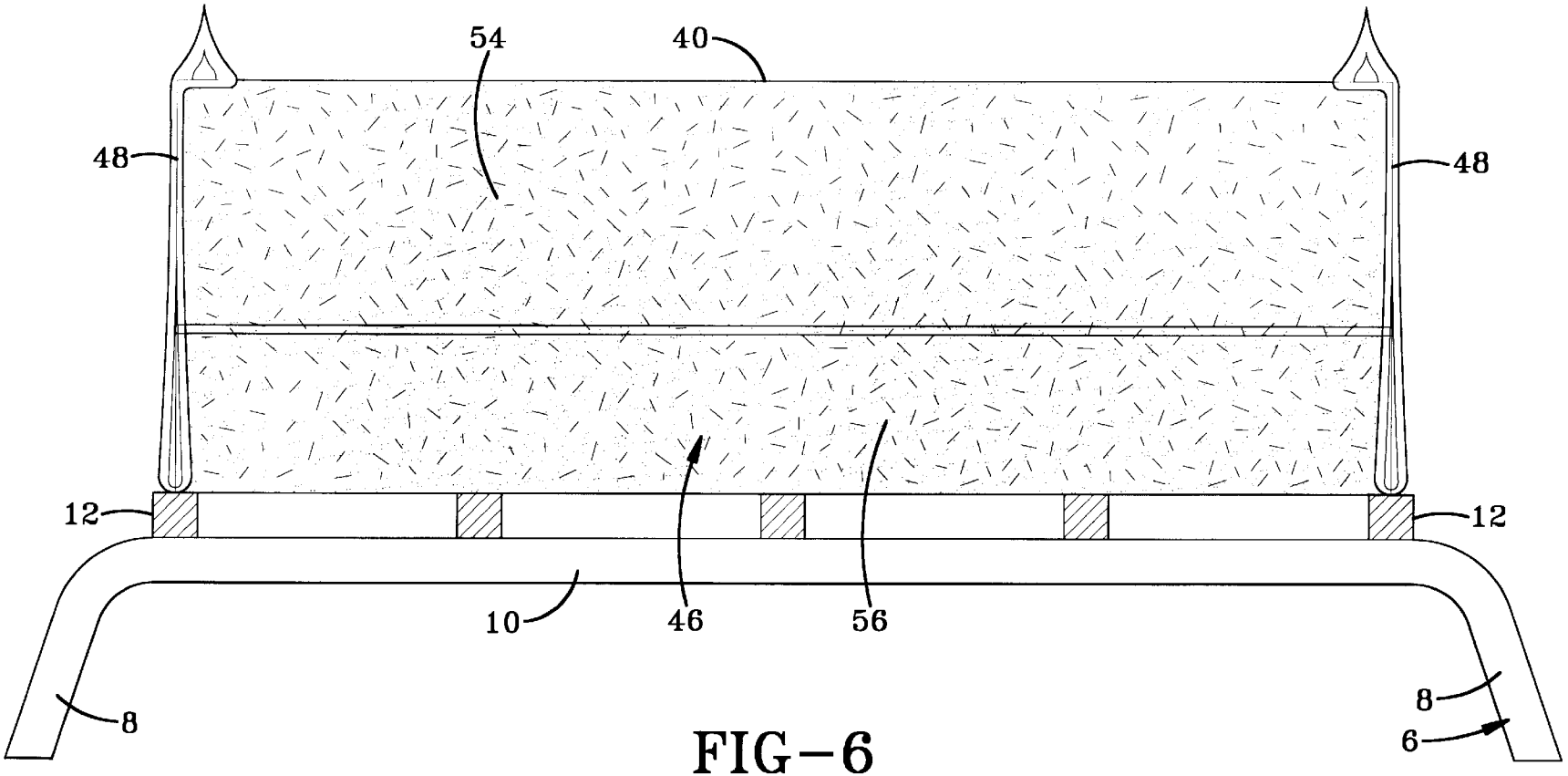
FIG. 6 is a front elevational view showing the ends of the fire log ignited.

Fire log 1 has a arcuate shaped top surface 40 (FIGS. 3–5), a substantially flat rear surface 42, a flat bottom surface 44, a front surface 46, and opposite ends 48 (FIG. 6). Bottom surface 44 is supported on ribs 12 of fireplace grate 4 when fireplace log 1 is burned as described below. In accordance with one of the features of the invention, a groove 50 is formed in the bottom rear corner of fire log 1 at a substantially 90° angle. Groove 50 extends along the entire length of fire log 1 and forms a flat protruding edge or lipped surface 52.

In the preferred embodiment, lipped surface 52 of groove 50 extends inwardly from rear surface 42 approximately ½". Groove 50 also forms a vertical surface 62 which extends vertically between lip surface 52 and bottom surface 44. Vertical surface 62 preferably extends approximately ¼" above bottom surface 44 of fire log 1.

In accordance with another of the features of the invention, front surface 46 is formed with an arcuate upper section 54 and a curved lower section 56. The inner ends of arcuate upper section 54 and curved lower section 56 intersect to form a generally V-shaped channel 58 in front surface 46 of fire log 1. Channel 58 extends the entire length of fire log 1 and has a flat inner surface 60 extending between and connecting upper and lower sections 54 and 56. Curved lower section 56 is slightly lopsided having a more exaggerated curve near inner surface 60 and straightening slightly towards bottom surface 44. Arcuate upper section 54 and top surface 40 of fire log 1 form a partial circle which extends from inner surface 60 of channel 58 to flat rear surface 42.

In accordance with another of the features of the invention, outer wrapper 18 is wrapped around fire log 1 whereby flap 24 is positioned at the rounded corner between rear surface 42 and top surface 40 (FIG. 2). Flap 24 extends vertically upward above top surface 40 of fire log 1 and functions as a wick with which fire log 1 is ignited. Flap 24 extends above fire log 1 and is easily accessible from its front (FIG. 1) allowing a user to light flap 24 with a starter match 66 (FIG. 2). Flap 24 is lit at several locations along the length of the fire log 1 and is preferably lit adjacent each of ends 20 of wrapper 18 and at least one location intermediate ends 20.

Once flap 24 is lit and burning (FIG. 3), the flame will spread along the entire length of flap 24 and burn towards rear surface 42 of fire log 1. When the flame has burned from the outer end of flap 24 to adjacent Fire log 1, the flame will ignite both top and bottom portions 28 and 30, respectively, of outer wrapper 18. The flame will burn top portion 28 in the direction of arrow A (FIG. 4) upwardly over top surface 40 of fire log 1. The flame will burn bottom portion 30 of wrapper 18 in the direction of arrow B until the flame burns wrapper 18 down to bottom surface 44 of fire log 1.

Fire log 1 is packaged within wrapper 18 whereby top portion 28 of wrapper 18 sticks to front surface 46 of fire log 1 and particularly to the outermost portions of arcuate upper section 54 and curved lower section 56 of front surface 46. As the flame travels in the direction of arrow A, the flame will burn the entire top portion 28 of outer wrapper 18 down to position D (FIG. 5) at the front bottom corner of fire log 1. Because there is no protruding edge or lip surface on which the flame can grab while burning at position D, the flame will eventually burn out at the front bottom corner of file log 1.

Figure 4:
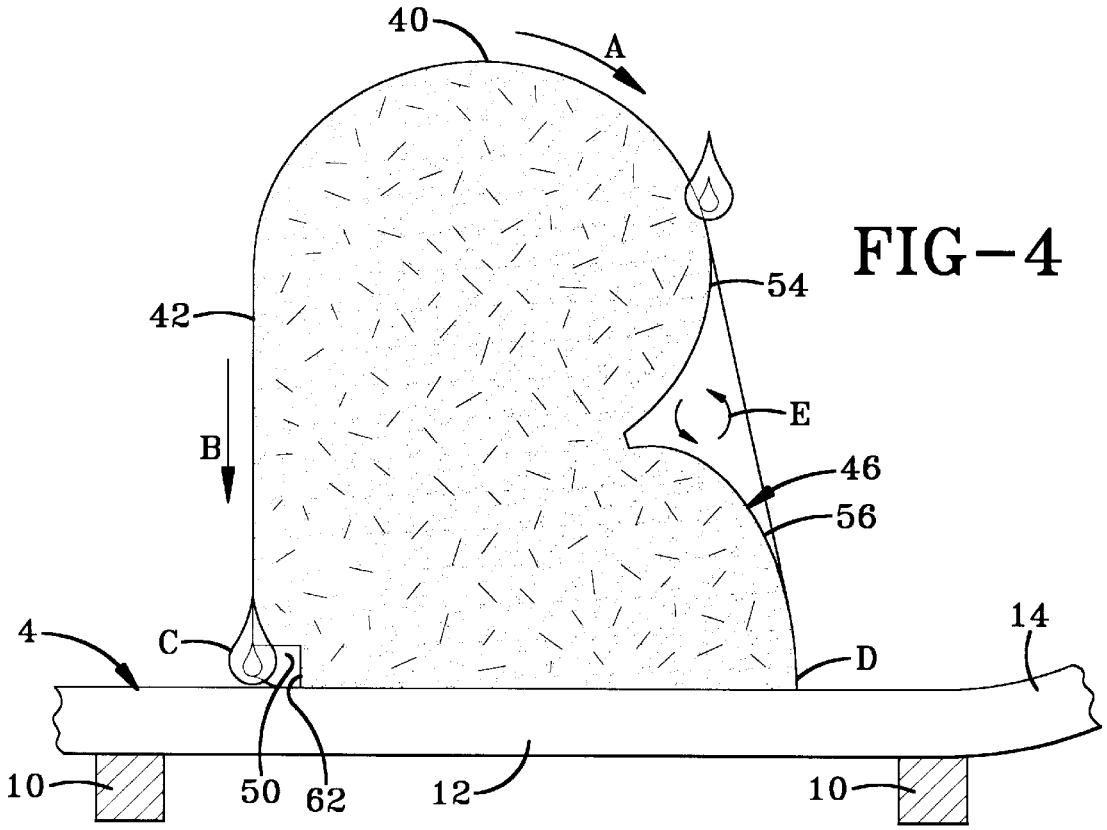
FIG. 4 is a sectional end view similar to FIG. 3 showing the path at which the flame burns the wrapper.

The flame burning bottom portion 30 of wrapper 18 will rest in the position indicated at C in FIG. 4 because of the flame's natural tendency to burn upwardly. When the flame burns wrapper 18 to the rear bottom corner of fire log 1, bottom surface 44 of fire log 1 and its abutment with grate 4 will impede the ability of the flame to burn the bottom of wrapper 18 causing the flame to stop traveling and rest at the bottom rear corner. Groove 50 will ignite when the flame reaches lipped surface 52. The flame rests at position C while it burns within groove 50 and eventually, the flame from bottom portion 30 of wrapper 18 will ignite the protruding edge created by lipped surface 52. The protruding edge gives the flame an edged surface to which the flame can grab or latch. Further, fire log 1 rests on ribs 16 of fireplace grate 4 and because of the lack of oxygen beneath fire log 1 and the tendency of the flame to burn upwardly, outer wrapper 18 will gradually burn out leaving flame C as the only ignited portion of log 1.

Figure 8:
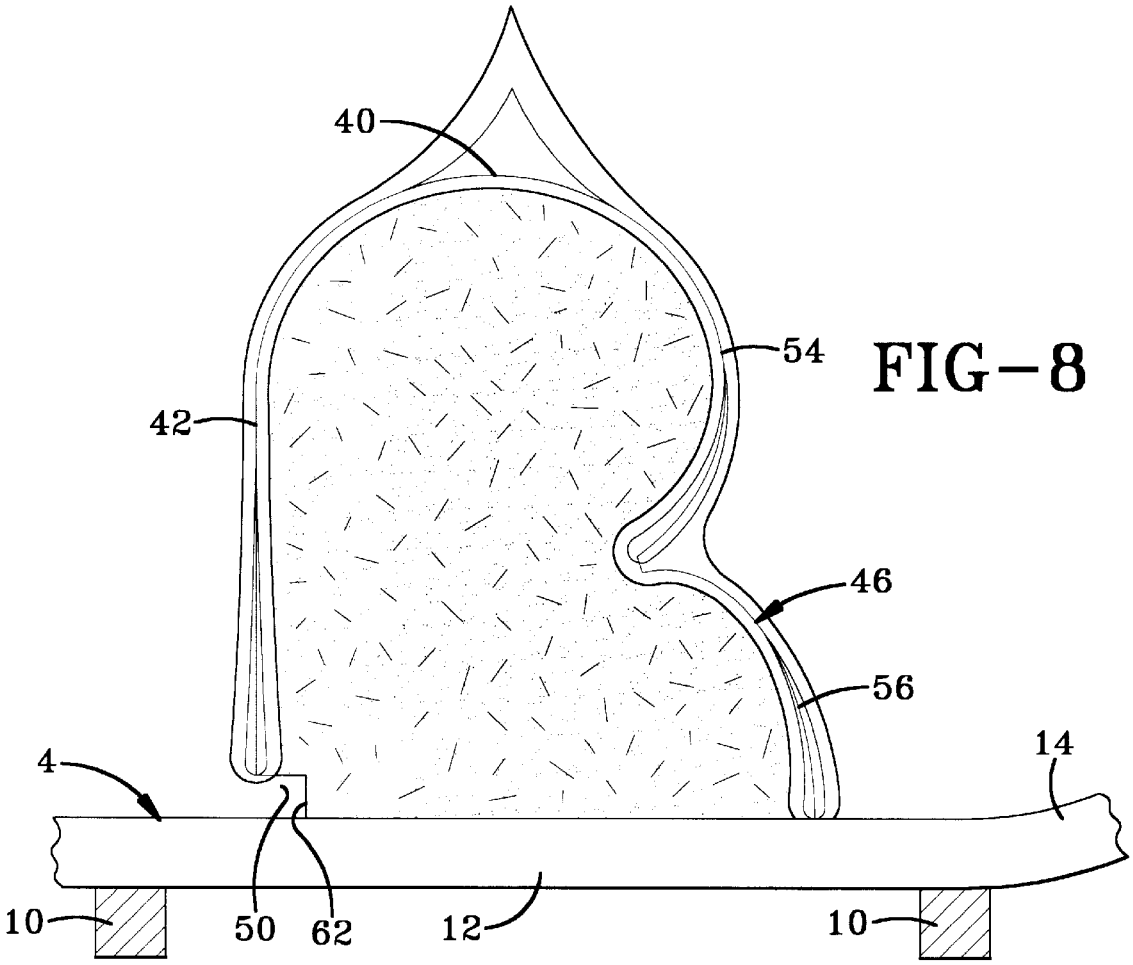
FIG. 8 is a sectional end view similar to FIG. 7 showing the fire log completely ignited.

Once the flame has latched on to lip surface 52 of groove 50, the flame will climb up rear surface 42 of fire log 1 (FIG. 5) at ends 48 of fire log 1 (FIG. 6). Ends 48 of fire log 1 are provided with the greatest amount of wrapper surface area to ignite the ends. Thus, during the initial burn stages, the flame climbs or travels up ends 48 and the rear corners between ends 48 and rear surface 42. When the flame has climbed all the way up rear surface 42 and ends 48, it will gradually creep inward along rear surface 42 and top surface 40 of fire log 1 (FIG. 6). The flame creeping in from opposite ends 48 of fire log 1 will eventually join in the middle of the fire log igniting the entire top and rear surfaces 40 and 42, respectively. The flame of top surface 40 will gradually creep down arcuate upper section 54 of front surface 46 and into channel 58. The flame gradually creeps from channel 58 down curved lower section 56 of fire log 1 resulting in complete ignition of the fire log (FIG. 8). Channel 58 assures that the single fire log of the invention gives the appearance of multiple logs positioned within the fireplace. Additionally, channel 58 provides a pocket which accepts combustible gases which allows the flame to burn gases within channel 58 providing a lively active flame on the front surface of fire log 1.

By burning the fire log initially from the rear and ends and letting the flame gradually travel inward along the top surface, then down the front surface, the fire log will burn for a relatively long duration, last longer and produce a moderate amount of heat for an extended period of time. Prior fire logs which burn simultaneously from both the front and rear surfaces burn faster than fire log 1 of the present invention and produce an excessive amount of heat for a shorter duration. Also, flap 24 may be positioned on various locations of wrapper 18 such as the front top corner but is placed at the top rear corner for aesthetic and packaging purposes.

Accordingly, fire log 1 is formed with a groove 50 which provides a protruding edge or lip surface 52 which provides a surface on which the flame can grab. Flap 24 of outer wrapper 18 functions as a wick with which fire log 1 is lit. Channel 58 provides an aesthetically pleasing front surface which does not burn until partially through the entire burning process. While providing the appearance of multiple logs positioned within the fireplace. The log is initially lit at opposed ends 48 and gradually creeps inward toward the middle of the log, then down front surface 46.

Accordingly, the improved fire log is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the the artificial fire log is constructed and used, the characteristics of the construction, and the advantageous, new and useful results obtained; the new and useful structures, devices, elements, arrangements, parts and combinations, are set forth in the appended claims.

I claim:

1. An artificial fire log comprising:

an elongated flammable body formed of compressed particulate material and a binder, said body having a pair of opposed end surfaces, a rear surface, a substantially flat bottom surface, a top surface and a front surface, said front surface having an upper portion and a lower portion;

a groove formed in a corner of the body between the bottom surface and one of the front and rear surfaces;

said groove being substantially empty and free of material.

2. The fire log defined in claim 1 in which the groove forms a protruding edge.

3. The fire log defined in claim 2 in which the upper portion of the front surface is generally arcuate-shaped.

4. The fire log defined in claim 3 in which the lower portion of the front surface is curved.

5. The fire log defined in claim 4 further including a channel formed in the front surface between the upper and lower portions.

6. The fire log defined in claim 2 in which the groove includes a substantially horizontal edge and a substantially vertical edge.

7. The fire log defined in claim 6 in which the groove is formed in the corner between the bottom and rear surfaces and forms substantially a 90 degree angle.

8. The fire log defined in claim 2 in which the top surface is arcuate-shaped and forms a continuous rounded surface with the upper portion of the front surface.

9. The fire log defined in claim 8 in which the lower portion of the front surface has a curved profile of varying radius.

10. The fire log defined in claim 9 in which the rear surface is substantially flat.

11. The fire log defined in claim 10 in which the body is formed of a mixture of sawdust and a wax binder.

12. The fire log defined in claim 1 further including a protective outer wrapper formed of a flammable material enclosing the elongated body, said wrapper generally conforming to the external configuration of said body; and a flap formed by the protective outer wrapper which extends upwardly away from said outer wrapper, said flap being positioned along the rear surface adjacent the top surface of the body.

13. An artificial fire log comprising:

an elongated flammable body formed of compressed particulate material and a binder, said body having a pair of opposed end surfaces, a rear surface, a bottom surface, a top surface, and a front surface, said front surface having an upper portion and a lower portion;

a groove formed in a corner of said body between said bottom surface and one of said front and rear surfaces;

said groove forming a protruding edge;

said upper portion of said front surface being generally arcuate-shaped;

said lower portion of said front surface being curved;

a channel formed in said front surface between said upper and lower portions; and said channel having upper and lower curved surfaces formed by the upper and lower portions, respectively, of the front surface.

14. A method of igniting an artificial fire log enclosed in a protective outer wrapper, said method comprising the steps of:

providing a fire log having a rear surface, a front surface, a bottom surface, and a groove formed between said bottom surface and one of said front and rear surfaces, with said groove being substantially empty and free of material;

igniting a flap of the protective outer wrapper;

burning a bottom portion of the wrapper to a bottom rear corner of the fire log; and igniting a protruding edge adjacent a groove formed in the bottom corner of the fire log.

15. The method defined in claim 14 further including the step of burning the bottom rear corner of the fire log along the entire length of said fire log.

16. The method defined in claim 15 further including the step of burning the fire log at a pair of opposed end surfaces of said fire log.

17. The method defined in claim 16 further including the step of burning the fire log from the opposed ends inwardly along a rear and top surface of the fire log.

18. The method defined in claim 17 further including the step of burning the fire log from the top surface down the front surface of the fire log.

19. The method defined in claim 18 further including the step of igniting a channel formed in the front surface of the fire log.

20. The method defined in claim 19 further including the step of burning the fire log from the channel down to a front bottom corner of the fire log resulting in complete ignition of the front, rear, top and end surfaces of the fire log.

21. An artificial fire log comprising:

an elongated flammable body formed of compressed particulate material and a binder, said body having a pair of opposed end surfaces, a rear surface, a substantially flat bottom surface, a top surface and a front surface, said front surface having an upper portion and a lower portion;

said upper portion of said front surface having an arcuate configuration; and said lower portion of said front surface having a curved profile discontinuous from the curved profile of the upper portion whereby the upper portion of the front surface and the lower portion of the front surface are positioned adjacent one another along a channel.

22. The firelog as defined in claim 21 in which said channel has an upper surface and a lower surface, and in which the upper portion of the front surface terminates at the upper surface, and in which the lower portion of the front surface terminates at the lower surface.

23. The firelog as defined in claim 22 in which the top surface is arcuate shaped, and is formed in a continuous rounded surface with the upper portion of the front face.

* * * * *